United States Patent [19]

Marik

[11] 4,427,182

[45] Jan. 24, 1984

[54] STAKE AND FORM REMOVAL DEVICE

[75] Inventor: Victor F. Marik, Houston, Tex.

[73] Assignee: Form & Stake Lifts, Inc., Houston, Tex.

[21] Appl. No.: 388,454

[22] Filed: Jun. 14, 1982

[51] Int. Cl.[3] ..... B66F 3/00

[52] U.S. Cl. ..... 254/131

[58] Field of Search ..... 254/131, 25, 11, 15–17, 254/44, 120, 121, 132; 30/169; 294/49, 50, 51, 55

[56] References Cited

U.S. PATENT DOCUMENTS

| | | | |
|---|---|---|---|
| Re. 30,316 | 7/1980 | Dushku | 254/121 |
| D. 168,534 | 1/1953 | Council | 254/131 |
| 441,979 | 12/1890 | Rohrbuch et al. | 254/25 |
| 1,971,785 | 8/1934 | Jersey | 254/121 |
| 2,068,046 | 1/1937 | Yardlay | 294/55 |
| 2,141,007 | 12/1938 | Meeh | 294/55 |
| 2,192,827 | 3/1940 | Dahl | 30/169 |
| 2,937,004 | 5/1960 | Striani | 254/131 |
| 3,504,578 | 4/1970 | Shannon et al. | 254/131 |
| 3,659,888 | 5/1972 | Dreier | 294/49 |
| 3,818,593 | 6/1974 | Oliverius | 30/169 |
| 4,281,866 | 8/1981 | Atcheson | 254/132 |
| 4,304,019 | 12/1981 | Sava | 254/131 |

*Primary Examiner*—Robert C. Watson

*Attorney, Agent, or Firm*—Robert W. B. Dickerson

[57] ABSTRACT

A tool for removing stakes and forms from around a hardened foundation, comprising: a body portion having [1] stake-and-form separating portion, [2] stake-receiving aperture means, and [3] form gripping portion; and a lever portion connected to said body portion, said lever portion including a foot rest at one end thereof.

4 Claims, 5 Drawing Figures

STAKE AND FORM REMOVAL DEVICE

BACKGROUND OF THE INVENTION

Foundations, especially house foundations or slabs, are normally formed by first constructing a wooden form perimeter, supported by stakes, providing structural reinforcement, such as steel rods, intermediate the form perimeter, pouring the concrete, and then, after hardening of the concrete, removing the wooden form and stake material. The last mentioned step, under the present state of the art, is not only quite time consuming, and therefore expensive, but oftentimes results in unseemly chipping and damage to the edge of the concrete foundation or slab. This invention has as its prime purpose the provision of a device permitting expenditious removal of primarily the stakes, and secondarily the forms, with greatly reduced damage to the hardened concrete. Sometimes herein, said forms and stakes are referred to as form material.

SUMMARY OF THE INVENTION

This invention comprises a tool having an extended hand grip or lever portion at one end, a body portion at the other end, and a pressure-exerting, foot rest intermediate its ends. The body or housing portion includes a first toothed or notched portion adapted to be driven intermediate the stake and adjacent form, and a stake receiving aperture. Said housing also includes, opposite from said first notched portion, a form gripping appendage having a second toothed or notched portion.

DESCRIPTION OF PREFERRED EMBODIMENTS

Figure 1:
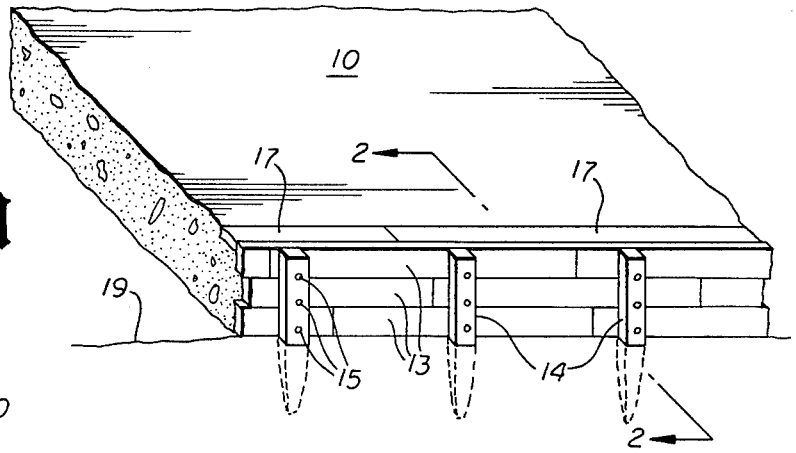
FIG. 1 is a broken perspective of a hardened slab, with form material still in position.
Figure 2:
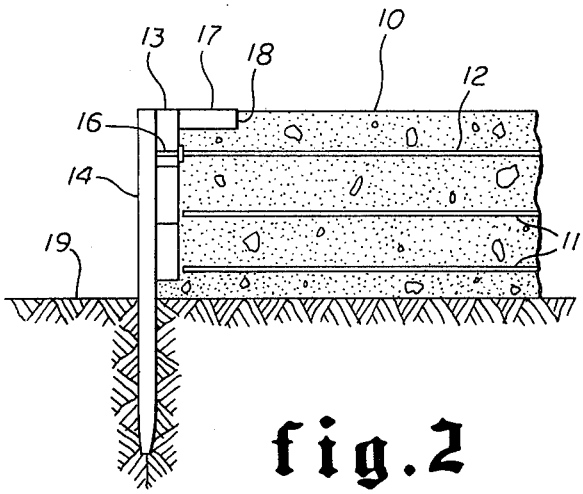
FIG. 2 is a section taken along lines 2—2 of FIG. 1.
Figure 3:
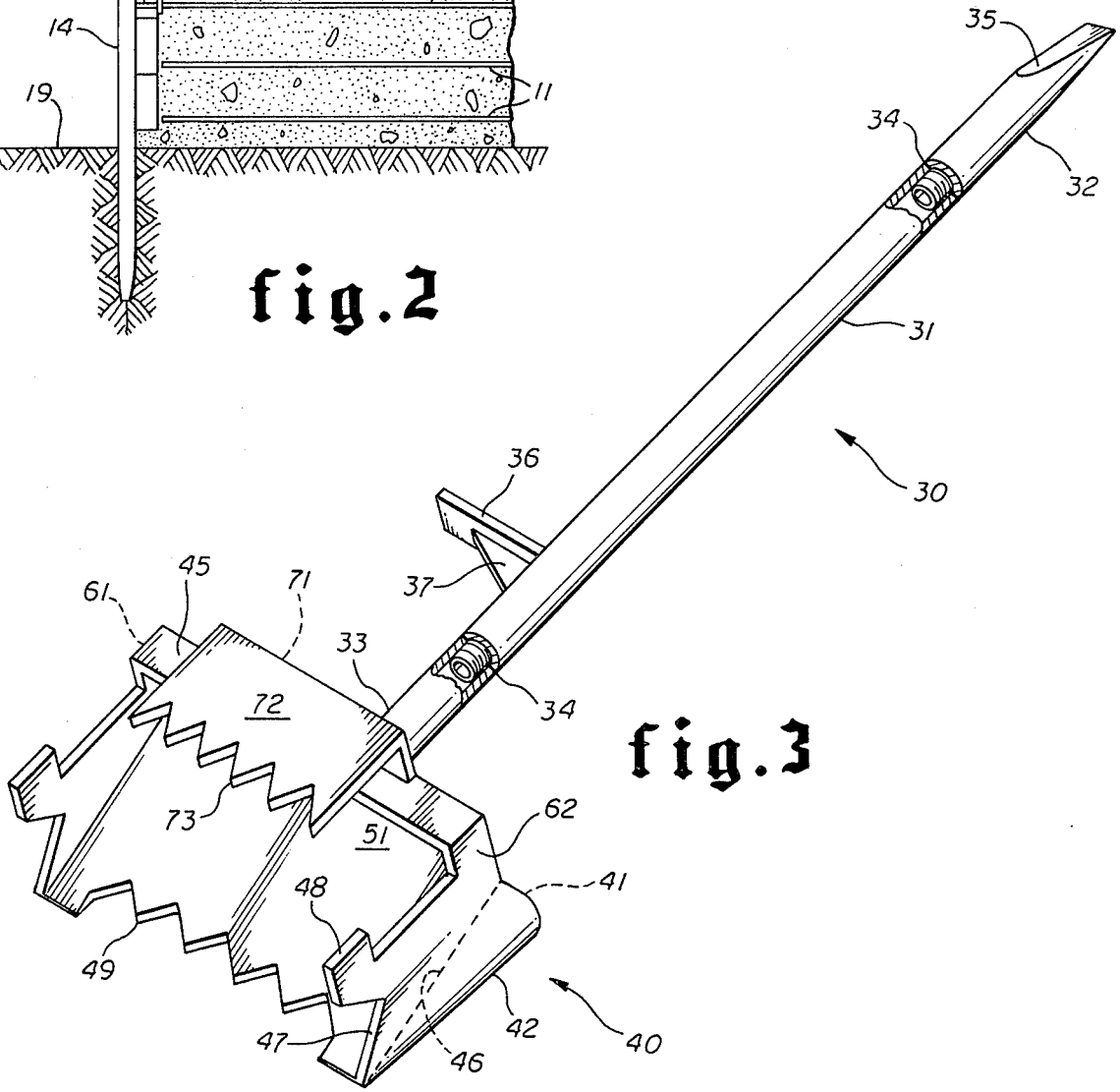
FIG. 3 is a front-perspective of a preferred embodiment of the invention.
Figure 4:
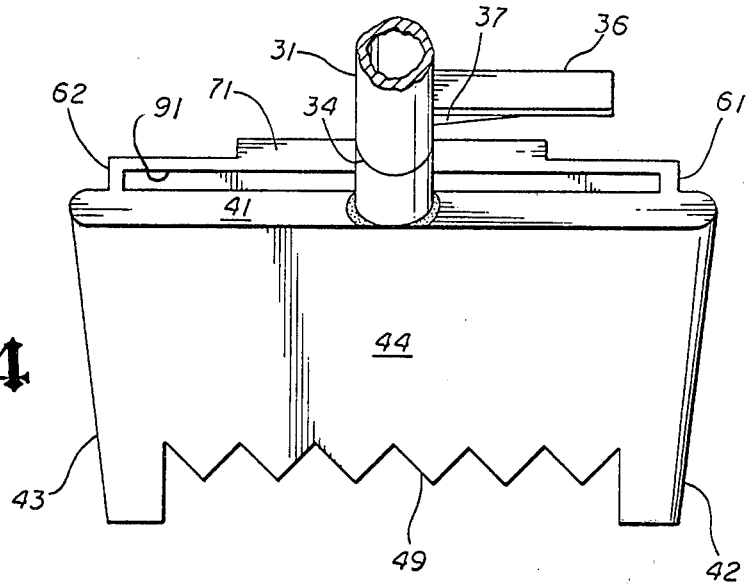
FIG. 4 is a broken, rear-perspective of the embodiment of FIG. 3.

Looking at the drawings, numeral 10 indicates the surface of a hardened foundation, slab, walkway, driveway, or the like. The ground surface is indicated at 19. Such slab may have reinforcing rods 11 extending therethrough, as well as stress taking members 12. Around the slab's periphery, form material is normally provided, to define its boundary, prior to pouring. Such form material may include vertically stacked forms 13, and laterally spaced stakes 14 which are driven into the ground, and connected, by nails 15, to the adjacent forms 13. The stress taking members 12 may also be removably attached by nails 16 to said forms 13. In some situations where brick or masonry facing material is to be used facing forms 17 may extend around the foundation periphery, forming a rectangular recess 18 therein.

This invention permits removal of the form material in such a manner as to greatly reduce slab damage, as well as to expedite removal of and reduce damage to the form material, which material oftentimes may be used again.

The device itself includes a lever, generally indicated at 30. Said lever includes a central portion 31, and opposite end portions 32 and 33. Fixed to the lower end portion 33, as by welding, is tool housing 40. Said upper and lower ends 32,33 may be integral with central portion 31, or may be removably affixed thereto, as by mating, threaded male and female portions, such junctures being indicated at 34. Upper end 32 may include oppositely disposed beveled portions 35, forming a pick-like tool, allowing the performance of such functions as picking away residual concrete, prying wooden members apart, or the like. Central lever portion 31 includes a depending foot rest plate 36, supported by strut 37. This allows a downward force to be exerted, to accomplish the purposes hereinafter described.

Housing 40 may be said to generally resemble a cutaway rectangular box, and includes plate 41 forming a relatively flat upper surface. It also includes sides 42, 43, a rear plate 44, and a shortened rectangular front plate 45, said box-like housing being open at the bottom. Interior of said housing, the interior of rear wall member 44 is cam or wedge configured, as at 46, with its greatest depth dimension being near housing top 41. This wedge configuration may be accomplished by so forming rear plate 44, or by inserting a separate wedge member.

A U-shaped, aperture forming appendage to housing 40 includes sides 61,62 and said front plate 45, forming, along with said wedge portion, a stake receiving passageway 51 which terminates in aperture 91.

Further depending from front plate 45, is an L-Shaped bracket or form gripping member comprising horizontal spacer 71, and depending bracket front plate 72. The lower entremety of said bracket front plate is toothed or notched at its lower edge 73. Further, rear housing plate 44, is also toothed or notched, at 49.

Opposite housing sides 42, 43, each have, at their lower ends, V-cuts 47, and a forwardly extending lug 48, which terminates approximately planar with housing front plate 45.

Consider now the use of the device. The user would be standing on the hardened concrete 10, and insert teeth 49 of back plate 44 between stake 14 (normally 1"×4") and upper form 13 (normally 2"×6"), applying foot pressure downwardly on foot plate 36 so as to wedge said teeth therebetween. The top of the stake 14 would be directed toward the interior of housing 40, with L-Shaped bracket 71, 72 extending outwardly from slab 10. When a slight entry is made by teeth 49 between said stake and form, lever 30 would be pivoted forwardly, causing the interior wedge surface 46 to push stake 14 away from the topmost form 13, against the restraint of the uppermost nail 15. Additional downward pressure exerted, coupled with forward rocking of lever 30, forces the housing downwardly about the stake, with wedge surface 46 urging said stake toward and through passageway 51 and the aperture 91. When the housing bottom 47, ie., the notched bottoms of sides 42, 43 reach the area of ground surface 19, the lever is pulled, rather than pushed, back toward slab 10, pivoting about upper form 13, causing teeth 49 to bite into the stake. As the housing arcuately moves upwardly about the lever's pivot point with form 13, the stake is lifted from the ground.

When the stakes are so removed, the housing 40 may be rotated 180 degrees, inserting teeth 73 inserted intermediate forms 13 and facing members 17, or the edge of slab 10 if no facing members are used, with the upper portion of forms 13 received in the rectangular area defined by bracket portions 71, 72 and housing front plate 45. Forward movement of lever 30, urges such forms away from slab 10, against the restraining force of nails 16.

Figure 5:
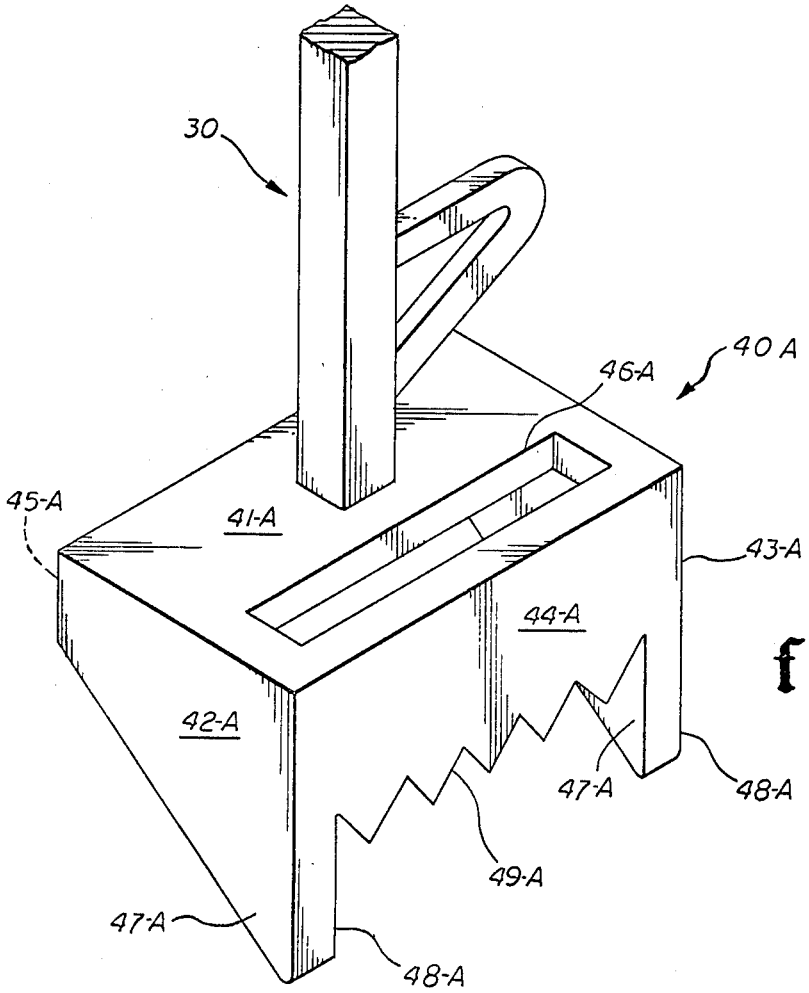
FIG. 5 is a broken, rear-perspective of a modified embodiment.

In the simplified embodiment of FIG. 5, lever 30 is similarly joined to a modified housing 40-A. Such housing includes upper plate 41-A, side plates 42-A, 43-A, rear plate 44-A, and shortened front plate 45-A. Aperture or passageway 46-A is formed in upper plate 41-A. Rear plate 44-A is notched at 49-A. Said side plates 42-A, 43-A have relatively short leading edges, relatively long trailing edges 48-A, said leading and trailing edges being connected by bottom edges 47-A. The operation, like the prior embodiment, involves inserting the teeth 49-A intermediate the form and stake, causing the stake top to pass through aperture 46-A, and eventually removing the stake by biting teeth 49-A therein on pivoting the lever.

While the foregoing description should adequately describe the increased ease with which form material can be removed, it should also be noted that there is little, if any, required contact between the inventive device and the hardened concrete, thereby greatly reducing any possible damage to the concrete.

Althrough only limited embodiments of the invention have been described, it should be obvious that numerous modifications would be possible by one skilled in the art without departing from the spirit of the invention, the scope of which is limited only by the following claims.

I claim:

1. A tool for removal of form material from around a slab, said tool comprising:

A housing having a wall, an upper surface depending from said wall, and a stake passing aperture extending through said upper surface, a lever member attached at one end to said housing;

said housing includes means for separating stake components from form components of said form material and further including means for removing said stake components from the subsurface, said separating means including a series of spaced teeth formed at one end of said wall of said housing, and said removing means including both an interior stake passageway through said housing communicating with said stake passing aperture through said upper surface of said housing and said series of spaced teeth.

2. The tool of claim 1 and including lever connected means for transmitting an exteriorly applied force from said lever to said housing wall teeth, thereby urging said teeth intermediate said stake and form components.

3. The tool of claim 2 wherein said force transmitting means includes a footrest depending from said lever.

4. The tool of claim 1 wherein said removing means further includes a cam surface on the interior of said housing wall.

* * * * *